United States Patent [19]

Hosaka et al.

[11] 4,167,925

[45] Sep. 18, 1979

[54] CLOSED LOOP SYSTEM EQUIPPED WITH A DEVICE FOR PRODUCING A REFERENCE SIGNAL IN ACCORDANCE WITH THE OUTPUT SIGNAL OF A GAS SENSOR FOR INTERNAL COMBUSTION ENGINE

[75] Inventors: Akio Hosaka, Yokohama; Masaharu Asano, Yokosuka, both of Japan

[73] Assignee: Nissan Motor Company, Limited, Japan

[21] Appl. No.: 863,603

[22] Filed: Dec. 23, 1977

[30] Foreign Application Priority Data

Dec. 28, 1976 [JP] Japan ..... 51/157567

[51] Int. Cl.[2] ..... F02B 33/00; F01N 3/00

[52] U.S. Cl. ..... 123/119 EC; 123/32 EA; 60/276

[58] Field of Search ..... 123/32 EA, 32 EC, 32 ED, 123/119 EC; 60/276, 285

[56] References Cited

U.S. PATENT DOCUMENTS

| | | | |
|---|---|---|---|
| 3,895,611 | 7/1975 | Endo et al. | 123/32 EE |
| 3,939,654 | 2/1976 | Creps | 60/285 |
| 3,986,352 | 10/1976 | Casey | 60/276 |
| 4,026,257 | 5/1977 | Fenn | 123/119 EC |
| 4,027,637 | 6/1977 | Aono | 123/119 EC |
| 4,029,061 | 6/1977 | Asano | 60/285 |
| 4,057,042 | 11/1977 | Aono | 60/285 |
| 4,075,982 | 2/1978 | Asano et al. | 123/119 EC |
| 4,088,095 | 5/1978 | Aono | 123/119 EC |
| 4,089,313 | 5/1978 | Asano et al. | 123/119 EC |
| 4,112,880 | 9/1978 | Asano et al. | 123/32 EA |

FOREIGN PATENT DOCUMENTS

| | | | |
|---|---|---|---|
| 2648791 | 5/1977 | Fed. Rep. of Germany | 123/119 EC |
| 2658940 | 7/1977 | Fed. Rep. of Germany | 123/119 EC |

*Primary Examiner*—Charles J. Myhre
*Assistant Examiner*—R. A. Nelli
*Attorney, Agent, or Firm*—Robert E. Burns; Emmanuel J. Lobato; Bruce L. Adams

[57] ABSTRACT

A reference signal with which the output of a gas sensor is compared is produced by detecting the maximum and minimum values of the output of the gas sensor and adding via a voltage divider these values to each other. The variation of the reference signal may be limited with predicted maximum and minimum values of the output of the gas sensor. The reference signal produced in such a manner may be utilized for disabling and reactivating the feedback control.

14 Claims, 9 Drawing Figures

CLOSED LOOP SYSTEM EQUIPPED WITH A DEVICE FOR PRODUCING A REFERENCE SIGNAL IN ACCORDANCE WITH THE OUTPUT SIGNAL OF A GAS SENSOR FOR INTERNAL COMBUSTION ENGINE

FIELD OF THE INVENTION

This invention relates to a closed loop control system of the type suited to controlling the air/fuel ratio of a combustible mixture fed to the combustion chambers of an internal combustion engine, and more particularly to a closed loop control system, including a difference signal generator for producing an output signal indicating the difference between the magnitude of the output signal of a gas sensor and the magnitude of a reference signal, equipped with a device for generating the reference signal in accordance with the maximum and minimum values of the output signal of the sensor.

BACKGROUND OF THE INVENTION

In closed loop control systems which control the operation of air/fuel forming devices of internal combustion engines such as carburetor and fuel injection systems it is usual to employ a gas sensor to sense a component of the exhaust gases issued from the engine which is indicative of air/fuel ratio of the combustible mixture being fed therein. In most cases the sensor is an oxygen sensor which uses a solid electrolyte such as zirconium.

Although the above-mentioned zirconium type oxygen sensor functions satisfactorily when the gas sensor is relatively new, when deteriorated with age the gas sensor may produce an output signal which does not correctly indicate the instantaneous air/fuel ratio. When the gas sensor produces such a signal the air/fuel ratio is controlled away from the stoichiometric air/fuel ratio.

In order to prevent the above-mentioned undesirable feedback control the present applicant has proposed two methods in Japanese patent application No. 50-117244 and in Japanese utility model application No. 50-145316. One of them involves the variation of the reference signal in accordance with the variation of the maximum value of the output signal of the gas sensor and the other method involves the variation of the reference signal in accordance with the mean value of the output signal of the gas sensor. However, since the former method does not include any means for compensating the reference signal in accordance with the minimum value, the reference signal is apt to include a large error in a range where the variation of the minimum value is large. In the latter method, the reference signal is apt to vary undesirably as time advances because the reference signal is produced by averaging the maximum and minimum values in time.

SUMMARY OF THE INVENTION

Hence the present invention has been developed to overcome the above-mentioned drawbacks of the prior art and provides a closed loop control system with a device for generating a reference signal in accordance with an upper transient envelope of maximum peak voltages and a lower transient envelope of minimum peak voltages of the output signal of the gas sensor. The upper transient envelope of maximum peak voltages and the lower transient envelope of minimum peak voltages will be respectively referred to as maximum value and minimum value hereinafter.

The reference signal generator is provided with circuitry which firstly receives the fluctuating output signal of the gas sensor to produce the upper and lower envelopes which are subsequently added and divided, in accordance with a predetermined ratio, to produce a single signal which in turn may be used as a reference signal in the closed loop control system. However, further circuitry is preferably provided in the reference signal generator which limits the variation of the single signal within predetermined upper (max.) and lower (min.) limits. These limits being so selected as to be within the two values at which the gas sensor signal is likely to remain constant for any length of time due to engine operational modes such as cold start, engine braking and the like. Hence, with this provision during the above-mentioned modes of engine operation when the upper and lower envelopes coincide, it is impossible for the reference signal to have a value equal to that of the gas sensor so that a difference between the two signals always occurs within the difference signal generator whereby feedback control or the air-fuel supply means is assured.

Further if the difference between the maximum and minimum values of the upper and lower envelopes falls below a predetermined level then it is preferred to disable the feedback control and since the reference signal generator according to the present invention includes maximum and minimum value detectors, the output signal of the detectors is utilized to produce a disable and reactivate control signal.

Therefore it is a primary object of the present invention to provide a closed loop control system equipped with a device for generating a reference signal in accordance with the maximum and minimum values of the output signal of a gas sensor where the feedback control is performed irrespectively of the output characteristic of the gas sensor.

Another object of the present invention is to provide such a system with which normal feedback control is obtained even though the output voltage of the gas sensor is maintained at its either maximum or minimum values during specific engine operational conditions.

Further object of the present invention is to provide such a system equipped with a device which temporarily disables the closed loop system when a gas sensor of the system is unable to provide an adequately wide output signal variation range and thus avoid erroneous and/or undesirable operation of the closed loop system.

BRIEF DESCRIPTION OF THE DRAWINGS

Other features, objects and advantages of the present invention will become more readily apparent from the following detailed description taken in conjunction with the accompanying drawings in which.

Corresponding elements are designated by the same reference numerals throughout the above-mentioned figures.

DETAILED DESCRIPTION OF THE PREFERRED EMBODIMENTS

Figure 1:
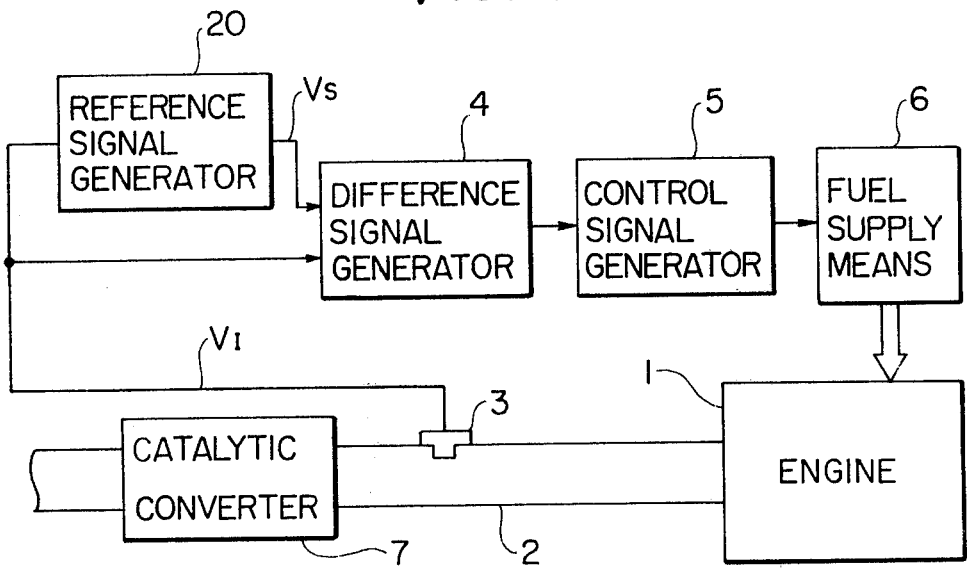
FIG. 1 shows in block diagram form a closed loop control system which includes a reference signal generator according to the present invention.

Reference is now made to FIG. 1 which shows the closed loop control system according to the present invention. A gas sensor 3 such as an oxygen ($O_2$) sensor is disposed in the exhaust gas passage 2 of an internal combustion engine 1. A catalytic converter 7 is shown disposed in the exhaust gas passage 2 for reducing harmful components contained in the exhaust gas. A difference signal generator 4 is arranged to produce a difference signal representative of the difference in magnitude between the output signal of the gas sensor 3 and a reference signal $v_S$ which represents a desired air/fuel ratio such as a stoichiometric air/fuel ratio. A control signal generator 5 which may include a P-I (proportional-integral) controller is utilized for generating a control signal in response to the difference signal. The control signal is then supplied to fuel supply means 6 such as a carburetor or an injection system. The above-mentioned arrangement is the same as the conventional closed loop control system with the exception that a reference signal generator 20 which generates the reference signal in accordance with the output signal of the gas sensor is further provided.

Figure 2:
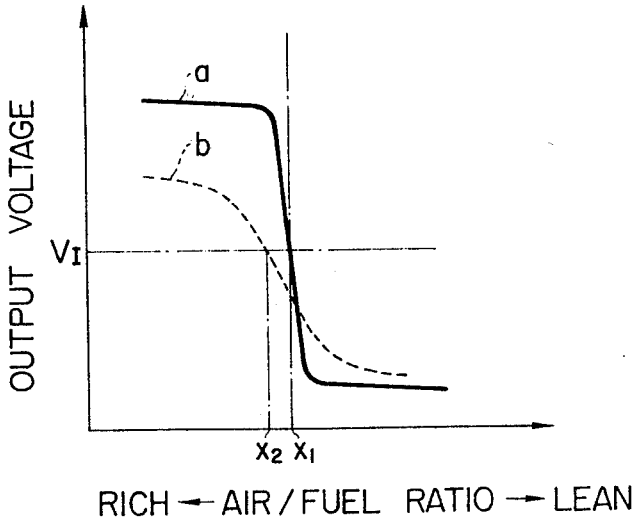
FIG. 2 is a graph which shows the air/fuel ratio-output characteristics of a gas sensor utilized in the closed loop control system.

Reference is now made to FIG. 2 which shows the relationship between the air/fuel ratio and the output voltage of the gas sensor 3. The curve "a" shown in the figure shows the characteristic of a gas sensor when used in normal conditions, i.e. when the gas sensor is relatively new and the temperature thereof is higher than a given level. The other curve "b" shows the characteristic of same gas sensor 3 when used in abnormal conditions, i.e. when the gas sensor has deteriorated with age or the temperature thereof is below a given level.

As shown in FIG. 2, in normal conditions the gas sensor produces an output voltage $V_I$ when exposed to an instantaneous air/fuel ratio $X_1$ which is in the vicinity of stiochiometric air/fuel ratio. However, in a deteriorated state the gas sensor 3 produces an output voltage $V_I$ when exposed to an instantaneous air/fuel ratio $X_2$ which is richer than the air/fuel ratio $X_1$. This means that when the gas sensor is utilized in a deteriorated state the gas sensor will produce an output signal which does not correctly represent the instantaneous air/fuel ratio.

Figure 3:
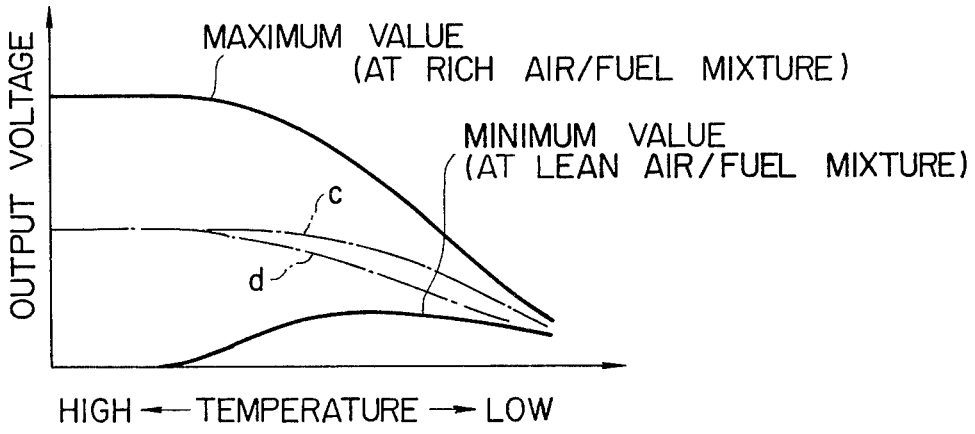
FIG. 3 is a graph which shows the temperature-output characteristics of the gas sensor.

Reference is now made to FIG. 3 which shows the relationship between the temperature and the output voltage of the gas sensor 3. The maximum value lowers as the temperature decreases while the minimum value rises as the temperature decreases. (Actually the minimum value slightly decreases after increasing at very low temperature.)

The curve "d" shows a variation of a reference signal utilized in prior art. The reference signal indicated by "d" is produced by dividing the maximum value by two. Since the reference signal "d" is dependant on only the maximum value, the magnitude of the reference signal "d" closely approaches the minimum value at low temperature range and sometimes becomes below the minimum value. The curve "c" shows a variation of the reference signal utilized in the present invention where the reference signal is determined by both the maximum and minimum values of the output signal of the gas sensor 3. The magnitude of the reference signal "c" is selected to be the same as the mean value of the maximum and minimum values. The method of producing the mean value will be described hereinafter in detail taken with the appended drawings.

Figure 4:
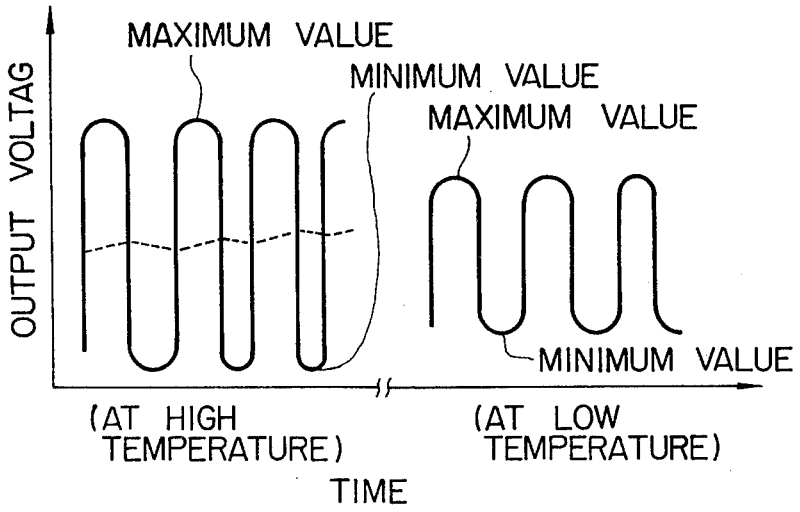
FIG. 4 is a graph which shows the time-output characteristics of the gas sensor.

Reference is now made to FIG. 4 which shows the relationship between the time and the output characteristic of the gas sensor 3. The dotted line shows a reference signal obtained by averaging the output signal of the gas sensor 3 in a conventional type of a closed loop control circuit. The reference signal is apt to rise or fall as time advances since the average value is obtained as a function of time. The graph shown in FIG. 4 shows a situation where the period of time for which the rich mixture is fed is longer than that for which the lean mixture is fed. Therefore the reference signal which is the average signal of the output of the gas sensor tends to rise as time goes by.

Figure 5:
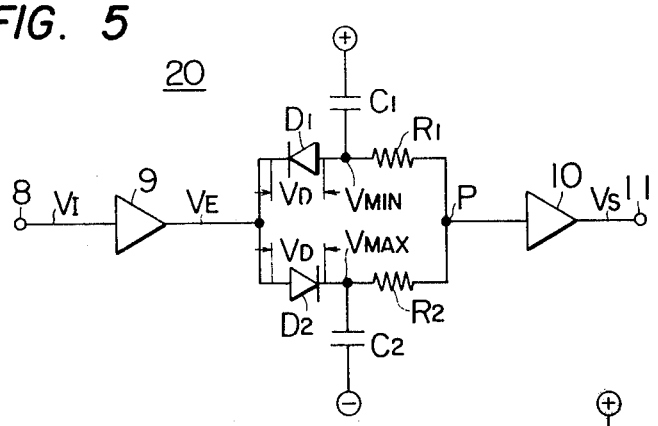
FIGS. 5 to 8 show first to fourth embodiments of the reference signal generator according to the present invention shown in FIG. 1.

Reference is now made to FIG. 5 which shows the first embodiment of the reference signal generator 20 according to the present invention shown in FIG. 1. An input terminal 8 is connected to an input of an amplifier 9 while the input terminal 8 is fed with the output signal $V_I$ of the gas sensor 3 shown in FIG. 1. A cathode of a first diode $D_1$ and an anode of a second diode $D_2$ are connected to each other and further to an output of the amplifier 9. The anode of the first diode $D_1$ is connected via a first capacitor $C_1$ to a positive power source "⊕" while the cathode of the second diode $D_2$ is connected via a second capacitor $C_2$ to a negative power source "⊖" of ground. The anode of the first diode $D_1$ and the cathode of the second diode $D_2$ are coupled via respective resistors $R_1$, $R_2$ at a node "P" while the node "P" is further connected to an input of a buffer amplifier 10. It is to be noted that the resistors $R_1$, $R_2$ constitute a voltage divider. The output of the buffer circuit is connected to an output terminal 11.

The function and the operation of the circuit shown in FIG. 5 will now be described. The input signal $V_I$ produced by the gas sensor 3 is suitably amplified by the amplifier 9 into a signal $V_E$. The signal $V_E$ flows through a pair of diodes $D_1$, $D_2$ and thus a pair of capacitors $C_1$, $C_2$ are charged and discharged in accordance with the magnitude of the signal $V_E$. The capacitor $C_1$, $C_2$ respectively store a minimum potential and a maximum potential of the signal $V_E$. The charged minimum and the maximum potentials of the signal $V_E$ are respectively discharged via the resistors $R_1$, $R_2$ so that instantaneous minimum and maximum potentials are stored respectively in response to the fluctuation of the signal $V_E$. This means that the diodes $D_1$, $D_2$ and the capacitors $C_1$, $C_2$ provide a peak to peak voltage follower. In order to protect the amplifier 9 the charge and discharge current may be limited by interposing a resistor between the output of the amplifier 9 and the pair of diodes $D_1$, $D_2$ in series.

The charged maximum and minimum values $V_{MAX}$, $V_{MIN}$ are divided by the resistors $R_1$, $R_2$ into a predetermined ratio, as an example a half of the difference between the maximum and minimum values. The resistance of the resistors $R_1$, $R_2$ may be selected for obtaining a suitable discharge time constant. When the resistances of resistors $R_1$, $R_2$ are large, the output impedance may be reduced by the buffer circuit 10 connected thereto. The output signal $V_S$ of the buffer circuit 10 is fed to the difference signal generator 4 shown in FIG. 1 and is utilized as a reference signal.

With this arrangement the reference signal $V_S$ is produced without the influence from the variation of the maximum and minimum values. Further the reference signal $V_S$ is produced irrespective of time for which the output of the gas sensor 3 assumes maximum or minimum value. This means that a desired feedback control of the air/fuel ratio is performed irrespective of the variation of the output characteristic of the gas sensor 3.

The charged potentials in capacitor $C_1$, $C_2$ are slightly different from the minimum and the maximum values of the signal $V_E$ respectively due to the voltage drop $V_D$ by diodes $D_1$, $D_2$. However, since the direction of the voltage drop $V_D$ by two diodes $D_1$, $D_2$ is opposite, the influence from the voltage drop $V_D$ may be offset if diodes $D_1$, $D_2$ have the same characteristics while the resistances of the resistors $R_1$, $R_2$ are same, i.e. when the circuit produces a voltage equal to half of the difference between the maximum and minimum values as described before.

Figure 6:
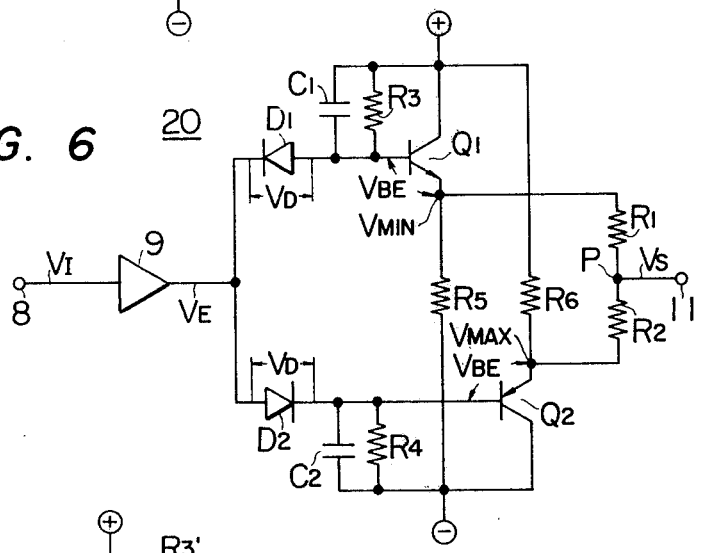

Reference is now made to FIG. 6 which shows a second embodiment utilized in order to offset the above-mentioned slight difference in potentials and also to reduce the output impedance of each signals each having minimum and maximum values. Corresponding parts are designated by the same reference numerals in this figure as in FIG. 5. A pair of transistors $Q_1$, $Q_2$ and four resistors $R_3$, $R_4$, $R_5$, $R_6$ are additionally incorporated in this second embodiment. The base of the transistor $Q_1$ is coupled to the anode of the diode $D_1$ and the collector of same is connected to the positive power source "⊕" while the base of the other transistor $Q_2$ is connected to the cathode of the diode $D_2$ and the collector of same to the negative power source "⊖". Resistors $R_3$ and $R_4$ are respectively provided in parallel with capacitors $C_1$, $C_2$. Resistors $R_5$, $R_6$ are respectively connected between the emitters of each transistor $Q_1$, $Q_2$ and negative and positive terminals of the power source where the emitters of both transistors $Q_1$, $Q_2$ are further connected via a pair of resistors $R_1$, $R_2$ connected in series to each other. The node "P" connecting the resistors $R_1$, $R_2$ is connected to an output terminal 11.

As before-mentioned, the potential of the charge in the capacitor $C_1$ is at the minimum value. However the potential is slightly higher than the real minimum value by the forward voltage drop $V_D$ across the diode $D_1$. The transistor $Q_1$ is an n-p-n type transistor and the voltage obtained through the emitter follower circuit of same is lower than the input voltage by the voltage drop $V_{BE}$ between the base and emitter of same. Since this voltage drop $V_{BE}$ is generally close to the other voltage drop $V_D$ across the diode $D_1$, the output voltage of the transistor $Q_1$ is very close to the real minimum value. The maximum value is also compensated through the transistor $Q_2$ which is a p-n-p type transistor in the same manner. Resistors $R_3$, $R_4$ are provided for discharging the stored charges in this embodiment.

In the circuit shown in FIG. 6 the output impedance is reduced because of the emitter follower circuit and thus the resistances of the resistors $R_1$, $R_2$ may be decreased and further a buffer amplifier such as shown in FIG. 5 may be omitted. With this arrangement the output voltage $V_S$ is obtained in proportion to the divided ratio even though the resistance of the resistor $R_1$ is not the same as that of the resistor $R_2$. It is to be noted that this circuit has an advantage when low output impedance is required or the divided ratio is determined at other than a half of the difference between the maximum and minimum values. The resistors $R_3$, $R_4$ are provided for determing the discharge time constant. Other operations of the second embodiment are the same as in the first embodiment shown in FIG. 5 thus a description of same is omitted.

Figure 7:
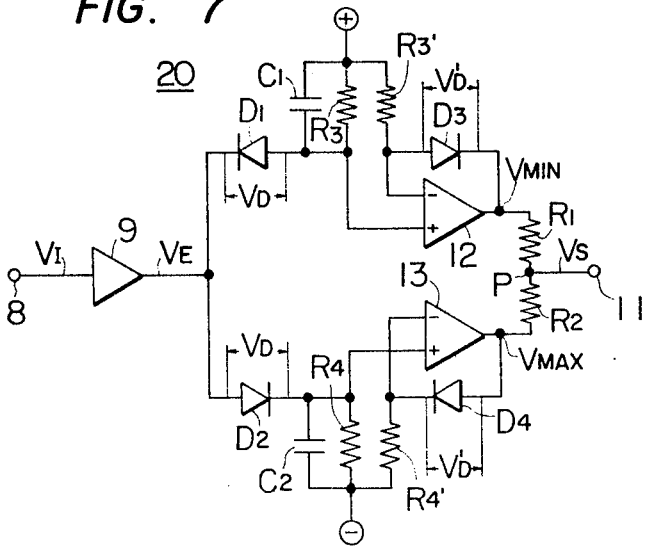

Reference is now made to FIG. 7 which shows the third embodiment in which the voltage drops $V_D$ due to diodes $D_1$ and $D_2$ are further compensated for. Corresponding parts are designated by the same reference numerals in this figure as in previous figures. A pair of operational amplifiers 12, 13 are additionally provided in this embodiment. The non-inverting input of the operational amplifier 12 is connected to the anode of the diode $D_1$ while the inverting input of same is connected via a resistor $R_3$, to the positive terminal "⊕" of the power source. The non-inverting input of the operational amplifier 13 is connected to the cathode of the diode $D_2$ while the inverting input of same is connected via a resistor $R_4$, to the negative terminal "⊖" of the power source. A pair of diodes $D_3$, $D_4$ are respectively connected across the operational amplifiers 12, 13 in which the anode of the diode $D_3$ is connected to the inverting input of the operational amplifier 12 and the cathode of the diode $D_4$ to the inverting input of the operational amplifier 13. The outputs of each operational amplifiers 12, 13 are connected via a pair of resistors $R_1$, $R_2$ to each other. The node "P" connecting the resistors $R_1$, $R_2$ is connected to an output terminal 11.

As described before, the potential of the charge in the capacitor $C_1$ is higher than the real minimum value by the voltage drop $V_D$. The output signal of the operational amplifier 12 is fed back via the diode $D_3$ to the inverting input of same and the non-inverting input is fed with the potential across the capacitor $C_1$. The voltage at the output of the operational amplifier 12 is lower than that of non-inverting input by the voltage drop $V'_D$ across the diode $D_3$. When the same diode characteristics are exhibited by the diodes $D_1$, $D_3$ and the resistance of the resistor $R_3$, is equal to that of the resistor $R_3$, the voltage drop $V'_D$ is equal to the voltage drop $V_D$ because the same amount of electric current flows through both diodes $D_1$ and $D_3$. Therefore the output voltage of the operational amplifier 12 is exactly equal to the minimum value. In the same manner the output voltage of the other operational amplifier 13 is exactly equal to the maximum value. With this arrangement the third embodiment shown in FIG. 7 provides an accurate difference between the maximum and minimum values at the output of the differential amplifier 11.

With this arrangement since the maximum and minimum values are accurately detected, the circuit shown in FIG. 7 is advantageous in that the circuit is utilized for disabling and reactivating the feedback control in accordance with the difference between the maximum and minimum values as will be described hereinafter and also it is possible to determine the divided ratio with which the reference signal $V_S$ is determined accurately. It is further to be noted that the output impedance of this circuit is also small.

Hereinbefore three embodiments of circuits for producing a reference signal by detecting the difference between the maximum and minimum values have been shown in FIGS. 5 to 7. However, other circuits such as a peak level detecting circuit, which is broadly used, utilizing an operational amplifier may be employed for detecting the maximum and minimum values.

In circuits shown in FIGS. 5 to 7 the feedback control may not be performed when the magnitude of the reference signal $V_S$ is the same as the output voltage $V_I$ of the gas sensor 3. This kind of situation may occur when the engine is operated for a long time at full acceleration with a fully opened throttle valve, deceleration by engine braking or when the engine is started at cold temperatures. In order to prevent this undesirable situation maximum and minimum values should be presented even though the magnitude of the output signal of the gas sensor remains constant. For producing the maximum and minimum values in the above-mentioned situation it is necessary to provide either an upper or lower limit for the reference signal. Namely, the variation range of the reference signal is preferably limited so as to be within the predicted maximum and minimum values at which the output signal of the gas sensor is likely to remain constant.

Through the above-mentioned arrangement the magnitude of the gas sensor output signal never coincides with the magnitude of the reference signal. As an example, assuming the output voltage of the gas sensor is at its minimum value, the reference signal is determined by the lower limit which is higher than the minimum value. Therefore there occurs a difference between the output signal of the gas sensor and the reference signal $V_S$ in magnitude and thus the air/fuel ratio is controlled toward a richer mixture. As the result the gas sensor then produces its output signal indicative of an air/fuel ratio which is richer than before. Through these operations the output of the gas sensor is caused to fluctuate as normal and thus a normal reference signal is obtained.

Figure 8:
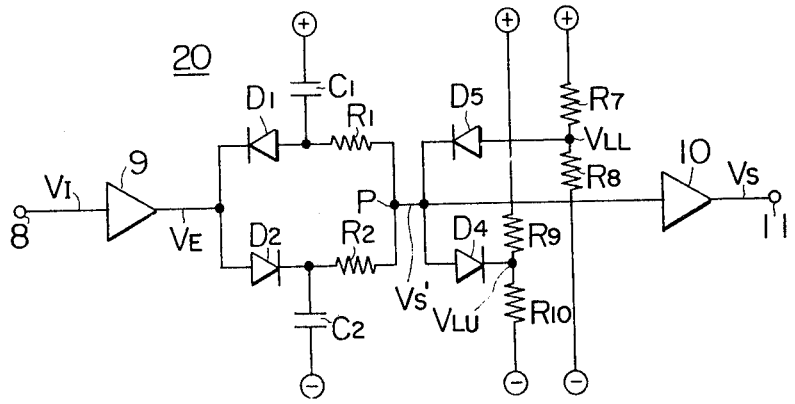

Hence reference is now made to FIG. 8 which shows the fourth embodiment of the reference signal generator in which the variation range of the reference signal $V_S'$ is limited within the maximum and minimum values. The circuit shown in FIG. 8 is the same as the circuit shown in FIG. 5 except a pair of diodes $D_5$, $D_6$ and four resistors $R_7$ to $R_{10}$ are provided. A pair of resistors $R_7$, $R_8$ are connected in series and interposed between the positive and negative terminals "⊕", "⊖" of the power source. Another pair of resistors $R_9$, $R_{10}$ are also connected in series and interposed between the positive and negative terminals of the power source. The anode of the diode $D_5$ is connected to the connection between the resistors $R_7$, $R_8$ while the cathode of same is connected to the node "P" to which the anode of the other diode $D_6$ is connected. The cathode of the diode $D_6$ is connected to the connection between the resistors $R_9$, $R_{10}$. The remaining construction is the same as that of the circuit shown in FIG. 5.

As shown in the figure, the two pairs of resistors $R_7$, $R_8$ and $R_9$, $R_{10}$ constitute two voltage dividers respectively. The resistances of the resistors $R_7$ to $R_{10}$ are relatively small compared to that of resistors $R_1$, $R_2$. The voltage divider which consists of the resistors $R_7$, $R_8$ produces a lower limit voltage $V_{LL}$ at the connection thereof while the other voltage divider which consists of the resistors $R_9$, $R_{10}$ produces an upper limit voltage $V_{LU}$ at the connection thereof. When the voltage $V_S$, at the node "P" tends to rise over the upper limit voltage $V_{LU}$, an electric current flows through the diode $D_6$ because of the forward bias and thus the voltage $V_S$, is prevented from rising over the upper limit $V_{LU}$. In the same manner the voltage $V_S$, at the node "P" is prevented from falling below the lower limit voltage $V_{LL}$ because of the forward bias of the diode $D_5$.

It is to be noted that though the circuit shown in FIG. 8 includes the circuit shown in FIG. 5 and the circuit for defining the upper and lower limit as described above, the circuit for defining the upper and lower limit may be adapted to those circuits shown in FIG. 6 and FIG. 7.

Figure 9:
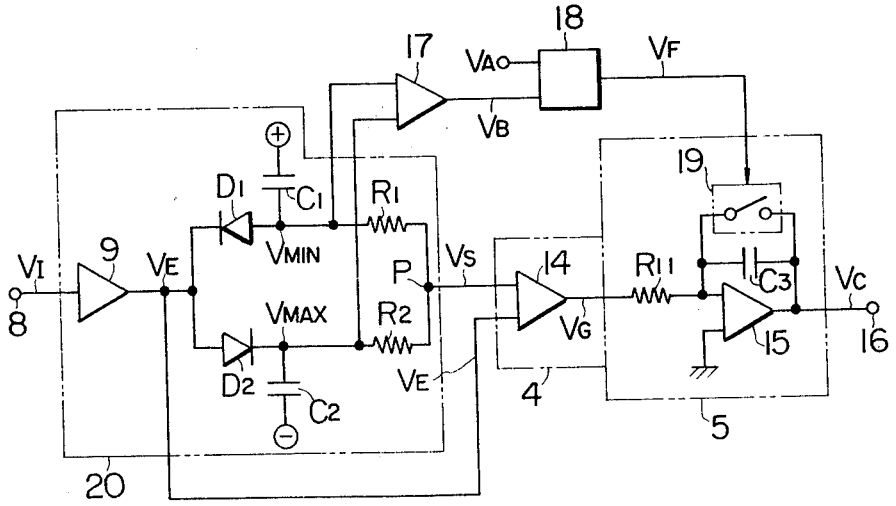
FIG. 9 shows an embodiment of circuitry which includes the reference signal generator, the difference signal generator and the control signal generator shown in FIG. 1 for disabling the feedback control in accordance with the output signal of the gas sensor.

Reference is now made to FIG. 9 which shows an embodiment for disabling the feedback control in accordance with the difference between the maximum and minimum values of the output signal of the gas sensor 3 shown in FIG. 1. The circuit shown in FIG. 9 includes the same circuit as shown in FIG. 5 except for the buffer amplifier 10, and further includes a pair of difference signal generators 14, 17, a comparator 18 and an integrating circuit 15, $R_{11}$, $C_3$ with a switching circuit 19. The comparator 14 is utilized as the difference signal generator 4 shown in FIG. 1 while the integrating circuit 15, $R_{11}$, $C_3$ is utilized as the control signal generator 5 shown in FIG. 1. The switching circuit 19 is employed for disabling the feedback control by producing a constant signal at the output of the integrator when energized.

The output of the amplifier 9 is connected to an input of the first difference signal generator 14 while the other output of the first difference signal generator 14 is connected to the node "P". The anode of the first diode $D_1$ and the cathode of the second diode $D_2$ are respectively connected to the inputs of the second difference signal generator 17. The output of the second difference signal generator 17 is connected to an input of the comparator 18 while the other input of the comparator 18 is fed with a reference signal $V_A$. The output of the first difference signal generator 14 is connected via a resistor $R_{11}$ to an input of an operational amplifier 15 while the other input of the operational amplifier 15 is connected to the ground. A capacitor $C_3$ is connected across the input and the output of the operational amplifier 15 while the switching circuit 19 is interposed in parallel with the capacitor $C_3$. The output of the operational amplifier is connected to an output terminal 16.

A reference signal $V_S$ is produced at the node "P" as described in FIG. 1 and is fed to the first difference signal generator 14. Since the first difference signal generator is fed with an output signal $V_E$ of the amplifier 9, the first difference signal generator 14 produces an output signal $V_G$ indicating the difference between the magnitudes of two signals $V_S$, $V_E$. The integrator 15, $R_{11}$, $C_3$ connected to the first difference signal generator 14 produces an output signal $V_C$ which is utilized as a control signal in response to the signal $V_G$. The control signal is arranged to be fed to the fuel supply means 6 shown in FIG. 1. An actuator (not shown) disposed in the fuel supply means 6 is actuated in response to the control signal so as to control the amount of fuel or air. With this arrangement the feedback control is performed.

However, when the difference between the maximum and minimum values is extremely small normal feedback control cannot be performed and the feedback control should be disabled. The second difference signal generator 17 is arranged to produce an output signal $V_B$ indicating the difference between the maximum and minimum values stored in the capacitors $C_1$, $C_2$. The comparator 18 produced an output signal $V_F$ when the magnitude of the signal $V_B$ is below the magnitude of the reference signal $V_A$. The switching circuit 19 is arranged to close upon presence of the signal $V_F$. With the arrangement of the combination of the second difference signal generator 17, the comparator 18 and the switching circuit 19, the feedback control is disabled when the difference between the maximum and minimum values is less than a predetermined level.

What is claimed is:

1. A closed loop control system of an internal combustion engine, in which feedback control of air/fuel mixture is performed, including: a gas sensor disposed in the exhaust passage of the engine, for producing a first signal representative of the concentration of a component contained in the exhaust gases; a first difference signal generator connected to said gas sensor for producing a signal representative of the difference in magnitude between said first signal and a first reference signal representative of a desired air/fuel ratio; a control signal generator connected to said first difference signal generator for producing a first control signal in response to said difference signal; and fuel supply means arranged to supply fuel to said engine, the amount of fuel being controlled in response to said first control signal: wherein the improvement comprises:

(a) a peak to peak voltage follower connected to said gas sensor for respectively producing second and third signals respectively indicating a higher transient envelope of maximum peak voltages and a lower transient envelope of minimum peak voltages of said first signal; and (b) a voltage divider connected to said peak to peak voltage follower for producing said first reference signal of a voltage obtained by dividing a voltage difference between voltages of said second and third signals at a predetermined ratio.

2. A closed loop control system as claimed in claim 1, wherein said peak to peak voltage follower comprises first and second capacitors each having first and second terminals, first and second rectifiers each having an anode and a cathode, and discharging means, said second terminal of said first capacitor being connected to said anode of said first rectifier, said second terminal of said second capacitor being connected to said cathode of said second rectifier, said cathode of said first rectifier being connected to said anode of said second rectifier, said first terminals of said first and second capacitors being respectively fed with positive and negative voltages, said discharging means being connected to said second terminals of said first and second capacitors, the connection between said first and second rectifiers being fed with said first signal so as to produce said second and third signals at said second terminals of said second and first capacitors.

3. A closed loop control system as claimed in claim 2, wherein said first and second rectifiers are diodes.

4. A closed loop control system as claimed in claim 2, wherein said voltage divider is utilized as said discharging means.

5. A closed loop control system as claimed in claim 1, wherein said peak to peak voltage follower consists of an input terminal connected to a cathode of a first diode and an anode of a second diode, a first capacitor interposed between an anode of said first diode and a positive power source, a second capacitor interposed between a cathode of said second diode and a negative power source, a pair of resistors respectively connected in parallel with said first and second capacitors, an n-p-n type transistor the base and the collector of which are respectively connected to said anode of said first diode and to said positive power source, a p-n-p type transistor the base and the collector of which are respectively connected to said cathode of said second diode and to said negative power source, and a pair of resistors respectively interposed between the emitter of said n-p-n type transistor and the negative power source and between the emitter of said p-n-p type transistor and the positive power source so as to respectively produce said second and third signals at the emitters of said transistors.

6. A closed loop control system as claimed in claim 1, wherein, said peak to peak voltage follower consists of an input terminal connected to a cathode of a first diode and an anode of a second diode $D_2$, a first capacitor interposed between an anode of said first diode and a positive power source, a second capacitor interposed between a cathode of said second diode and a negative power source, a pair of resistors respectively connected in parallel with said first and second capacitors, a first operational amplifier the positive input of which is connected to the anode of said first diode, a second operational amplifier the positive input of which is connected to the cathode of said second diode, a second pair of resistors respectively interposed between the negative input of said first operational amplifier and the positive power source and between the negative input of said second operational amplifier and the negative power source, a third diode the anode and the cathode of which are respectively connected to the negative input of said first operational amplifier and the output thereof, and a fourth diode the cathode and the anode of which are respectively connected to the negative input of said second operational amplifier and the output thereof so as to respectively produce said second and third signals at the output of said operational amplifiers.

7. A closed loop control system as claimed in claim 1, wherein said voltage divider includes first and second resistors connected in series by a node each of said first and second resistor being respectively supplied with said second and third signals for producing said reference signal at said node.

8. A closed loop control system as claimed in claim 1, further comprising a limiter circuit connected to said voltage divider, said limiter circuit providing a limited variation range for the reference signal.

9. A closed loop control system as claimed in claim 8, wherein said limiter circuit functions to provide an upper limit for the reference signal.

10. A closed loop control system as claimed in claim 8, wherein said limiter circuit functions to provide a lower limit for the reference signal.

11. A closed loop control system as claimed in claim 8, wherein said limiter circuit functions to provide upper and lower limits for the reference signal.

12. A closed loop control system as claimed in claim 1, further comprising a second difference signal generator connected to said peak to peak voltage follower for producing a difference signal indicating the difference between said second and third signals, a comparing circuit connected to said second difference signal generator for producing a disable-reactivate control signal by comparing the magnitude of the difference signal with a second reference signal fed thereto, and a switching circuit connected to said control signal generator for disabling and reactivating the feedback control in accordance with the disable-reactivate control signal.

13. A closed loop control system as claimed in claim 1, further comprising an amplifier interposed between the input terminal and the peak to peak voltage follower for proportionally amplifying said first signal.

14. A closed loop control system as claimed in claim 7, further comprising a buffer amplifier connected to said node for producing a low impedance reference signal.

* * * * *